US006200057B1

(12) United States Patent
Youngs et al.

(10) Patent No.: US 6,200,057 B1
(45) Date of Patent: *Mar. 13, 2001

(54) STORAGE DEVICE

(75) Inventors: Ross O. Youngs, Dublin; James L. Weatherford, Hilliard; Roger J. Gerdeman, Columbus, all of OH (US)

(73) Assignee: Univenture, Inc., Columbus, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/586,148

(22) Filed: Jun. 2, 2000

Related U.S. Application Data

(63) Continuation-in-part of application No. 09/327,442, filed on Jun. 5, 1999, now Pat. No. 6,099,187.

(51) Int. Cl.[7] ..... B42F 3/00

(52) U.S. Cl. ..... 402/60; 402/26; 402/61; 402/63

(58) Field of Search ..... 402/26, 31, 60, 402/36, 37, 38, 39, 40, 41, 42, 70, 73, 8, 61, 63; 281/15.1, 21.1, 36

(56) References Cited

U.S. PATENT DOCUMENTS

| | | |
|---|---|---|
| 1,673,842 | 6/1928 | Netter, Sr. . |
| 2,042,366 | 5/1936 | Swank . |
| 2,133,069 | 10/1938 | Williamson . |
| 2,329,786 | 9/1943 | Ringler . |
| 2,451,122 | 10/1948 | Sherwood . |
| 2,559,556 | 7/1951 | Ambler . |
| 2,575,583 | 11/1951 | Clarke et al. . |
| 2,911,977 | 11/1959 | French . |
| 3,008,470 | 11/1961 | Rubinstein . |
| 3,083,714 | 4/1963 | Foster . |
| 3,087,498 | 4/1963 | Vogel . |
| 3,197,830 | 8/1965 | Hoadley . |
| 3,246,653 | 4/1966 | Sexton . |
| 3,251,364 | 5/1966 | Goldman . |
| 3,260,264 | 7/1966 | McKowen . |
| 3,313,303 | 4/1967 | Beyer . |
| 3,313,304 | 4/1967 | Beyer . |
| 3,331,373 | 7/1967 | Lohmeier . |
| 3,383,786 | 5/1968 | McIntosh . |
| 3,516,755 | 6/1970 | Smith . |
| 3,612,709 | 10/1971 | Miyamoto . |
| 3,834,824 | 9/1974 | Jahn . |
| 3,850,488 | 11/1974 | Elias et al. . |
| 3,927,949 | 12/1975 | Clinch . |
| 3,950,107 | 4/1976 | Seaborn . |

(List continued on next page.)

FOREIGN PATENT DOCUMENTS

| | | |
|---|---|---|
| 3708432 | 9/1988 | (DE) . |
| 2614841 | 11/1988 | (FR) . |
| 1209770 | 10/1970 | (GB) . |
| 2213432 | 8/1989 | (GB) . |

*Primary Examiner*—Willmon Fridie, Jr.
(74) *Attorney, Agent, or Firm*—Wood, Herron & Evans, L.L.P.

(57) ABSTRACT

A storage device for retaining one or more sheet items for access by a user. The storage device has a storage device cover including front and rear panels, and contains one or more first binding members which receive apertures formed in the sheet items to register the sheet items relative to the cover. One or more second binding members are hingedly connected to the storage device cover and preferably operate independently of the front and rear panels of the cover to engage the first binding members. Retained sheet items are able to be moved from a first position generally parallel with the rear panel to a second position generally parallel with the front panel. Alternatively, the storage device includes a single panel that carries the first and second binding members.

43 Claims, 10 Drawing Sheets

U.S. PATENT DOCUMENTS

| | | | |
|---|---|---|---|
| 3,954,343 | 5/1976 | Thomsen . | |
| 4,000,951 | 1/1977 | Agnew et al. . | |
| 4,120,517 | 10/1978 | Staats . | |
| 4,174,909 | 11/1979 | Jahn . | |
| 4,192,620 | 3/1980 | Jahn . | |
| 4,200,404 | 4/1980 | Agnew et al. . | |
| 4,256,411 | 3/1981 | Podosek . | |
| 4,261,664 | 4/1981 | Crawford . | |
| 4,295,747 | 10/1981 | Errichiello . | |
| 4,307,972 | 12/1981 | Errichiello . | |
| 4,340,316 | 7/1982 | Jahn . | |
| 4,761,091 | 8/1988 | Ominato et al. . | |
| 4,765,768 | 8/1988 | Wright . | |
| 4,941,804 | 7/1990 | Sarpy, Jr. . | |
| 5,163,768 | 11/1992 | Salisbury et al. . | |
| 5,167,463 | 12/1992 | Corbishley . | |
| 5,377,825 | 1/1995 | Sykes et al. . | |
| 5,405,209 | 4/1995 | Johns et al. . | |
| 5,618,122 | 4/1997 | Constantine . | |
| 5,667,323 | 9/1997 | Whaley | 402/26 |
| 5,697,721 | 12/1997 | von Rohrscheidt . | |
| 6,099,187 * | 8/2000 | Youngs | 402/60 |

* cited by examiner

STORAGE DEVICE

The present application is a continuation-in-part of U.S. Ser. No. 09/327,442, entitled STORAGE DEVICE, filed on Jun. 5, 1999 now U.S. Pat. No. 6,099,187, the disclosure of which is hereby incorporated herein by reference in its entirety.

FIELD OF THE INVENTION

This present invention relates generally to storage devices and, more particularly, to a storage device for retaining one or more sheet items for access by a user.

BACKGROUND OF THE INVENTION

Storage devices for sheet materials such as paper or plastic film exist in a variety of shapes and constructions. One representative storage device is the ring binder, containing a front cover, back cover and spine, which encloses a two or three ring binding element which can be opened to introduce punched paper or similar sheet-like material and then reclosed. These binders are relatively expensive to manufacture because of both the cost of the binder mechanism and the labor to secure this mechanism onto the spine of the binder cover. In addition, the metal binder rings, particularly in larger dimensions, tend to become misaligned with use. As a result, over time the stored sheets do not turn freely over the rings, and can occasionally become ripped from the misaligned metal.

Another known binder device for punched sheets uses spaced flexible metal straps which are secured to a binder cover. These metal straps are in turn fed through holes punched in paper or similar sheet-like material and then secured in place by feeding the straps through holes in a separate upper plate and attaching the straps to the plate. This binder device does not permit the punched sheets to freely rotate in the metal straps. Rather, the sheets are maintained in a single orientation. With repeated opening and closing of the binder mechanism the metal straps become bent and do not attach as efficiently to the plate.

Yet another binding device incorporates a releasable tensioned plate secured to a binder cover which permits insertion of the sheets to be stored followed by tightening of the tensioning device. This binding device does not require prior hole punching of the sheets. Nonetheless, the device is susceptible to loosening, resulting in loss of sheets from the binding device. If the quantity of sheets becomes too large, it is possible for sheets near the center to fall out of the device even with the stack under tension. Also, the sheets are only maintainable in a single orientation; they cannot rotate relative to the tensioned plate.

Each of the above binder device designs permits the storage of a variable number of pages. Nonetheless, these designs incorporate binding mechanisms which require relatively complex manufacturing steps and the expenditure of labor in installing these mechanisms into a binder, as well as having deficiencies in effectively storing sheet materials.

There remains a need for a binder device which will effectively store a variable number of pages and will retain all stored pages, yet at the same time provide easy access to individual pages. It is also preferred that this type of binding device be produced inexpensively and be able to be used and reused with little risk of damage to the device or the stored sheets.

SUMMARY OF THE INVENTION

The present invention overcomes the foregoing and other shortcomings and drawbacks of storage devices heretofore known. While the invention will be described in connection with certain embodiments, it will be understood that the invention is not limited to these embodiments. On the contrary, the invention includes all alternatives, modifications and equivalents as may be included within the spirit and scope of the present invention.

The present invention is directed to a storage device for retaining at least one sheet item for access by a user. In one embodiment of the present invention, the storage device includes a storage device cover having front and rear panels, one or more first binding members which are associated with the cover and which receive apertures of the sheet item or items to be stored, and one or more second binding members which are hingedly connected to the cover. The second binding members are operable to move independently of the front and rear panels and into engagement with the first binding members. The storage device provides temporary or permanent storage of the retained sheet items, and is configured in a manner to permit the retained sheet items to move from a first position generally parallel with the rear panel of the device to a second position generally parallel with the front panel of the device. In an alternative embodiment of the present invention, the storage device includes a single panel that carries the first and second binding members.

Depending on the composition of the manufacturing material, the storage device of the invention may be constructed as a unitary molded piece. Alternately, the various components may be separately secured to the cover of the storage device, as by use of adhesives, by welding, by fastening means, or by other known bonding or attaching techniques.

The above and other objects and advantages of the present invention shall be made apparent from the accompanying drawings and the description thereof.

BRIEF DESCRIPTION OF THE DRAWINGS

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION OF THE PREFERRED EMBODIMENT

Figure 1:
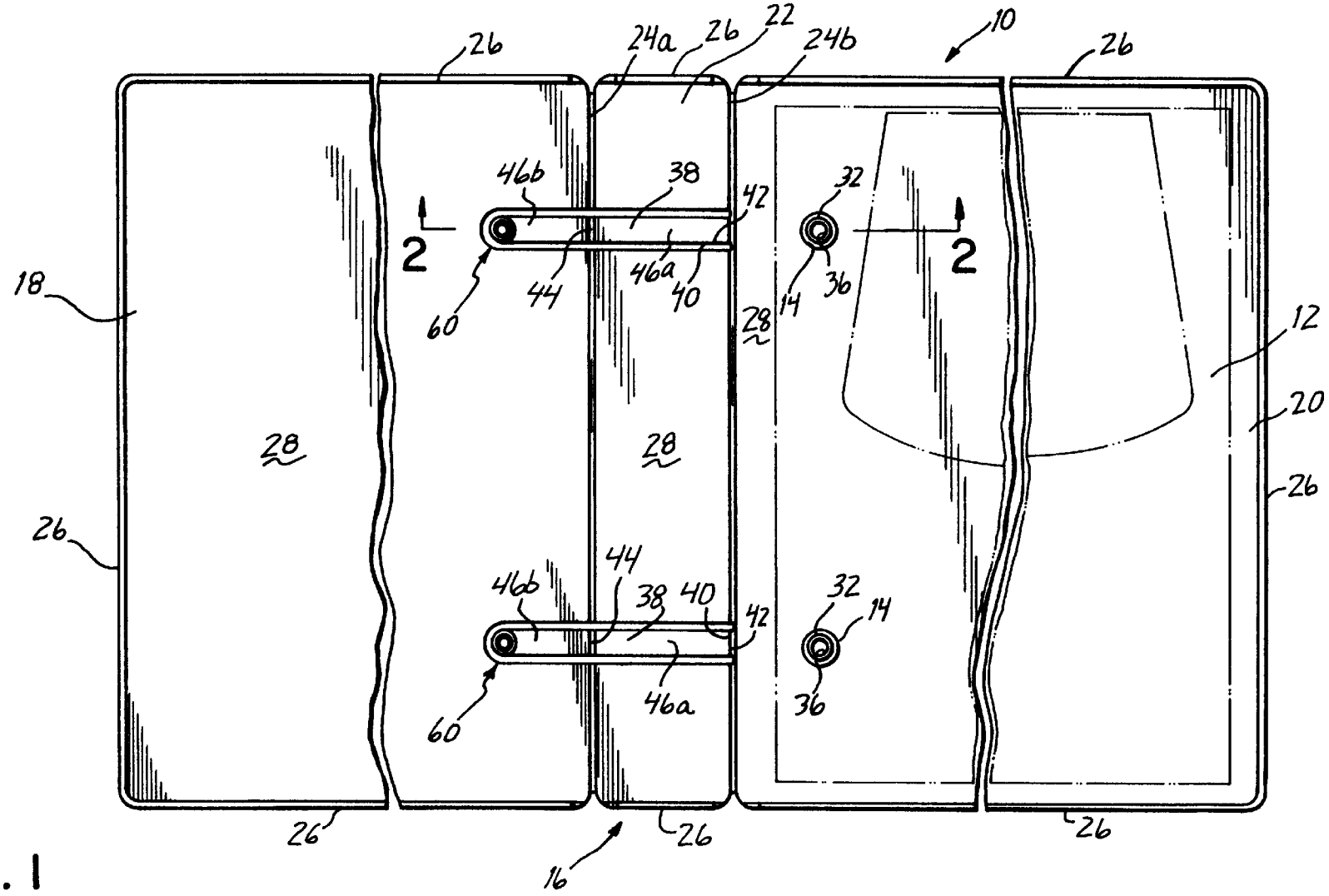
FIG. 1 is a top plan view of a storage device in accordance with one embodiment of the present invention.

With reference to the figures, and to FIG. 1 in particular, a storage device 10 in accordance with the principles of the present invention is shown for retaining one or more sheet items 12 shown in phantom within the storage device 10. Sheet items 12 are preferably hole punched to include apertures 14 that permit the sheet items 12 to be registered and retained within the storage device 10 as will be described in detail below. While sheet items 12 are illustrated in FIG. 1 as comprising a storage container for a compact disc, it is contemplated that storage device 10 of the present invention is readily adaptable to retain other types of sheet items that are customarily stored in a binder system, including photo album sheets, recipe cards and plastic or paper sheets for example, as will be appreciated by those skilled in the art.

Storage device 10 includes a storage device cover 16 that is preferably integrally molded or formed from a resiliently flexible synthetic plastic material such as polypropylene, although other materials including polyethylene polymer, polyvinyl chloride polymer, polyethylene terephthalate polymer, and metal are contemplated as well. Acceptable materials are capable of being formed into the requisite shape and have sufficient durability to withstand repeated opening and closing of both the storage device cover 16 and the binding mechanisms to be described in detail below.

Storage device cover 16 includes a front panel 18 hingedly connected to a rear panel 20, and preferably includes a spine panel 22 disposed intermediate the front and rear panels 18, 20 to which the front and rear panels 18, 20 are connected. The front and rear panels 18, 20 are preferably hingedly connected to opposite elongated sides of the spine panel 22 through living hinges 24*a*, 24*b*, respectively, formed in the storage device cover 16. Living hinges 24*a*, 24*b* are preferably elongated reduced thickness areas formed in the storage device cover 16 through conventional techniques that permit the front and rear panels 18, 20 to be readily folded by hand at the living hinges 24*a*, 24*b*, but may also comprise creased or score lines (not shown) or any other type of flexible formation as known in the art. Storage device cover 16 is operable to be folded from an open position as shown most clearly in FIGS. 1–3, to a closed position as shown most clearly in FIGS. 4 and 7.

In the open position of storage device cover 16, the front panel 18, rear panel 20 and spine panel 22 may be supported on a support surface (not shown) with each of the panels 18, 20, 22 lying in a generally common plane. Alternatively, in the closed position of storage device cover 16, the front panel 18 and rear panel 20 are superimposed in generally parallel planes, while the spine panel 22 lies in a plane generally transverse to the planes defined by the front and rear panels 18, 20.

Figure 7:
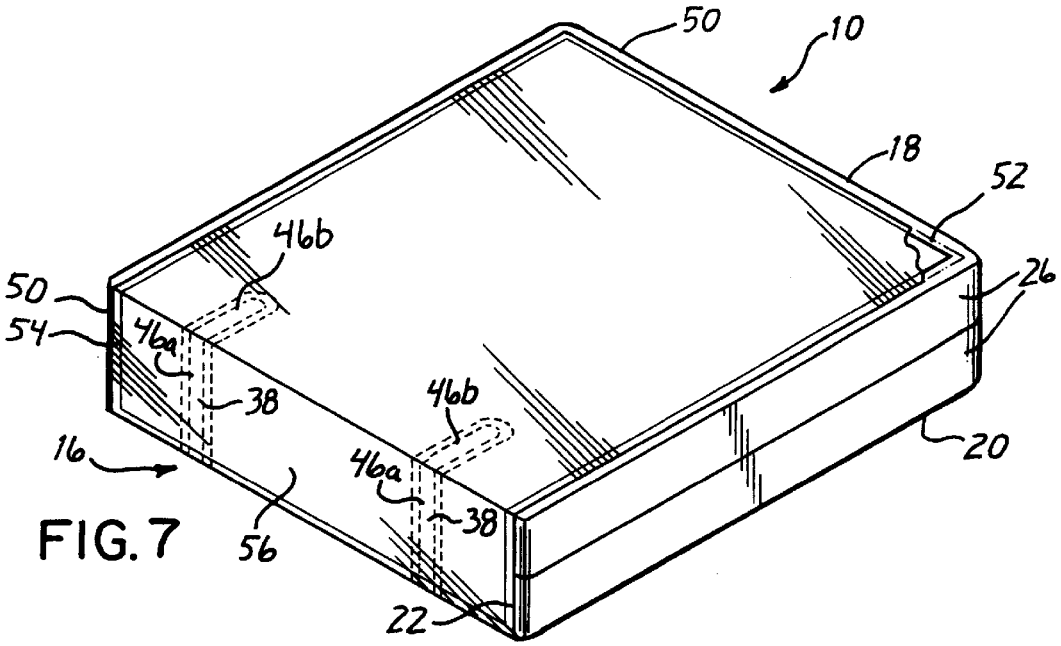
FIG. 7 is a perspective view of the storage device shown in FIG. 1 in the closed position.

As best understood with reference to FIGS. 1, 2–4 and 7, storage device cover 16 preferably includes a substantially continuous flange wall 26 extending upwardly from an inner surface 28 of the storage device 10 proximate marginal edges of the storage device cover 16. Flange wall 26 is preferably integrally molded or formed with storage device cover 16 during formation of the storage device 10. Upon folding of the storage device cover 16 to the closed position as shown in FIG. 7, the flange wall 26, front panel 18, rear panel 20, and spine panel 22 are adapted to form a closed chamber 30 (FIG. 4) within the storage device 10 in which the sheet items 12 are stored.

Referring now to FIGS. 1–4, storage device 10 includes one or more binding mechanisms 32, preferably in the form of spaced rigid or semi-rigid posts as illustrated in the figures, that are operable to extend completely through the apertures 14 formed in the sheet items 12 to register the sheet items 12 relative to the storage device cover 16. The posts 32 extend away from the inner surface 28 of the storage device 10, and may be integrally formed with the storage device cover 16 during formation of the storage device 10, or may alternatively be attached to the storage device cover 16 by the use of adhesives, by welding, by fastening means, or by other known bonding or attaching techniques.

Figure 2:
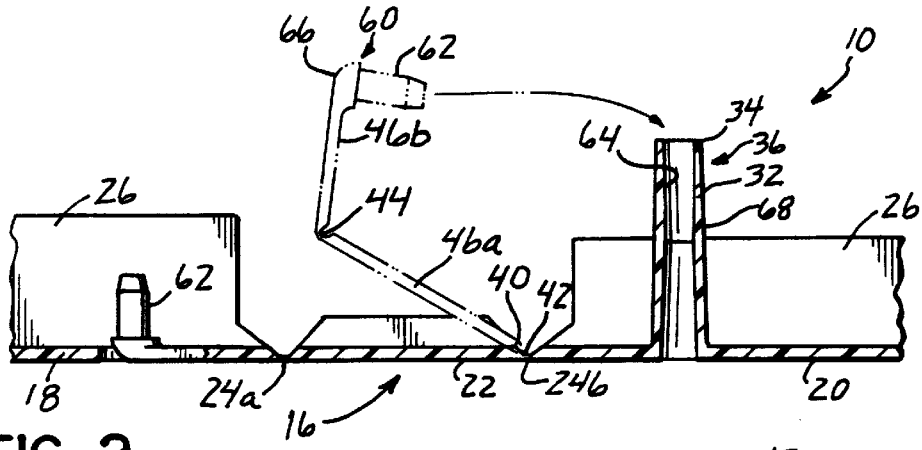
FIG. 2 is a cross-sectional view taken along line 2—2 of FIG. 1 showing the storage device in an open position and illustrating an elongated tongue member moving into engagement with a post member of the storage device.
Figure 3:
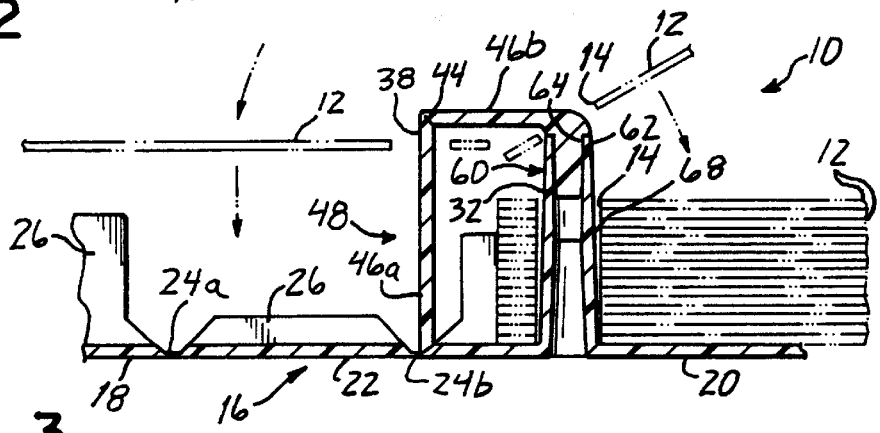
FIG. 3 is a view similar to FIG. 2, showing the storage device in an open position and illustrating the elongated tongue member engaged with the post member to form a binder strap.

Preferably, the posts 32 extend upwardly from the rear panel 20 so that the sheet items 12 may be readily placed on or removed from the posts 32 when the storage device cover 16 is unfolded to the open position as shown in FIGS. 2 and 3. Posts 32 preferably extend generally perpendicularly to the rear panel 20, although it is contemplated that the posts 32 may angle slightly inwardly toward the spine panel 22 along their entire lengths or at least proximate their remote ends 34 for purposes to be described below. Preferably, posts 32 terminate in the remote ends 34 below the front panel 18 when the storage device cover 16 is folded to the closed position, as best understood with reference to FIG. 4. While posts 32 are illustrated as extending away from rear panel 20, it will be understood that posts 32 may, in an alternative embodiment not shown, extend away from the front panel 18 without departing from the spirit and scope of the present invention.

Still referring to FIGS. 1–4, posts 32 are preferably formed as hollow, tubular members that terminate proximate their remote ends 34 in connection members 36, preferably in the form of female receptacles. Alternatively, posts 32 may be solid along a substantial part of their respective lengths and terminate proximate their remote ends 34 in the female receptacles 36. While posts 32 are illustrated as being generally circular in cross-sectional shape, it will be appreciated that posts 32 may have other cross-sectional shapes and dimensions that permit the posts 32 to extend completely through the apertures 14 formed in sheet items 12 without departing from the spirit and scope of the present invention.

Further referring to FIGS. 1–4, storage device 10 includes one or more binding members 38, preferably in the form of elongated tongue members as illustrated in the figures, that are hingedly connected to the storage device cover 16. The hinged connection of the tongue members 38 to the storage device cover 16 may take many forms, including mere folding of the storage device cover 16 material that permits the tongue members 38 to be folded by hand relative to the storage device cover 16. Preferably, tongue members 38 are integrally molded or formed with storage device cover 16 during formation of the storage device 10. Alternatively, it is contemplated that the tongue members 38 may be cut from the storage device cover 16 after formation of the storage device 10 through conventional cutting techniques, while maintaining a hinged connection with the storage device cover 16 at one end of the tongue members 38. In an alternative embodiment (not shown), tongue members 38 may be attached to the storage device cover 16 by the use of adhesives, by welding, by fastening means, or by other known bonding or attaching techniques.

Preferably, tongue members 38 are hingedly connected at one end 40 to the storage device cover through living hinge 42 that is coextensive with living hinge 24*b*, as best understood with reference to FIGS. 1–4. In this exemplary embodiment, the tongue members 38 extend from living hinge 42 transversely through the spine panel 22 and partially transversely through the front panel 18. Of course, other hinge connections and arrangements of the tongue members 38 are possible without departing from the spirit and scope of the present invention.

Preferably, each of the tongue members 38 includes at least one living hinge 44 extending generally transverse to the longitudinal length of the tongue members 38. Living hinges 44 may be coextensive with living hinge 24*a*, as best understood with reference to FIGS. 1–4. The living hinges 44 permit the tongue members 38 to be folded into multiple segment components 46*a*, 46*b*, as best understood with reference to FIGS. 2–4. Each of the multiple components 46*a*, 46*b* preferably includes a substantially linear component along its respective length. Tongue members 38 have a cross-sectional width that is less that the diameter of apertures 14 formed in sheet items 12 for purposes to be described in detail below.

Still referring to FIGS. 1–4, the hinged connections of tongue members 38 with the storage device cover 16 permit the tongue members 38 to be moved into engagement with the posts 32 to form elongated binder straps, indicated generally at 48, upon which the sheet items 12 are free to travel. Binder straps 48 are preferably generally defined by the combined lengths of posts 32 and tongue members 38, and are operable to permit the sheet items 12 to be moved along the binder straps 48 from a first position lying generally parallel with the rear panel 20 to a second position lying generally parallel with the front panel 18, as best understood with reference to FIG. 3.

Preferably, tongue members 38 are operable to move independently of the front panel 18 and the rear panel 20 so that engagement of the tongue members 38 with the posts 32 may be maintained when the storage device cover 16 is unfolded to the open position. Upon engagement of the tongue members 38 with the posts 32, segment components 46*a* of tongue members 38 preferably extend generally perpendicular to the rear panel 20, while segment components 46*b* extend generally parallel to the rear panel 20 in the open and closed positions of storage device cover 16.

Preferably, in the closed position of storage device cover 16, segment components 46*a* of tongue members 38 lie generally in the plane defined by spine panel 22, while segment component 46*b* lies generally in the plane defined by front panel 18. In this way, generally continuous outer surfaces 50 are formed on the storage device 10.

In one embodiment of the present invention as best understood with reference to FIG. 7, an overlay 52 may be attached to the storage device cover 16. The overlay 52 may be transparent to form one or more pockets 54 adjacent the outer surfaces 50. The pockets 54 are adapted to receive indicia bearing sheets 56 that may identify the contents of storage device 10 and also conceal any interruptions in the front panel 18 and spine panel 20. Alternatively, the overlay 52 may include graphics or printed identification material, or may be semi- or non-transparent to conceal the outer surfaces 50 of the storage device cover 16.

Figure 6:
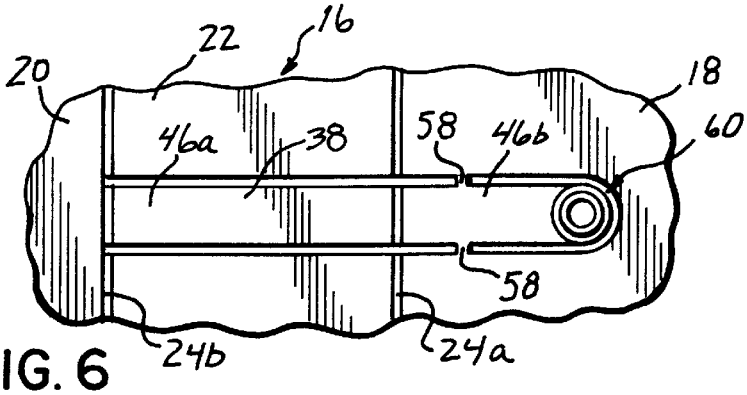
FIG. 6 is a partial plan view showing the storage device of FIG. 1 in accordance with an alternative embodiment of the present invention.

As shown in FIG. 6, breakable webs 58 may be provided to connect the tongue members 38 to the front panel 18 or spine panel 22, or both, so that during folding of the storage device cover 16, the tongue members 38 will automatically engage the posts 32. However, when the storage device cover 16 is first opened by the user, the webs 58 will break to allow the front panel 18 and spine panel 20 to be unfolded, while permitting the engagement of the tongue members 38 and posts 32 to be maintained.

Figure 4:
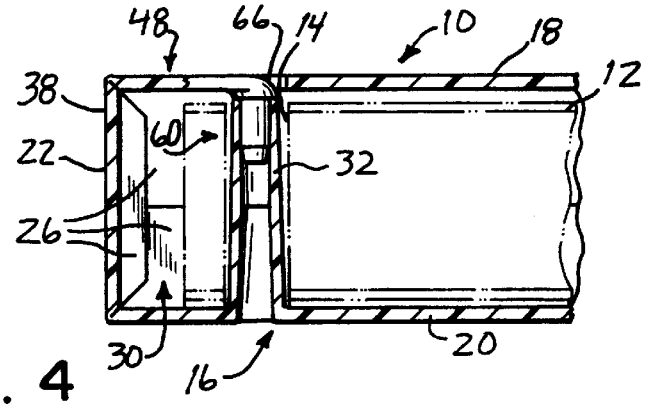
FIG. 4 is a view similar to FIG. 3, showing the storage device in a closed position.

As best understood with reference to FIGS. 2–4, each of the tongue members 38 terminates proximate one end in a connection member 60, preferably in the form of a generally cylindrical male plug body. Plug bodies 60 may be integrally molded or formed with the tongue members 38, or may be alternatively attached to the tongue members 38 by the use of adhesives, by welding, by fastening means, or by other known bonding or attaching techniques. Each plug body 60 is configured to be received in the female receptacles 36 so that an engagement may be established between the tongue members 38 and the posts 32 to form the binder straps 48.

As shown in FIGS. 2–3, the male plug bodies 60 may include a cylindrical wall 62 that is adapted to frictionally engage a cylindrical inner all 64 of the posts 32. In this way, a releasable connection or engagement may be established between the tongue members 38 and the posts 32. Each tongue member 38 may include a radius 66 formed above the connection member 60 that, in combination with a cylindrical outer wall 68 of the posts 32, forms a smooth transition area on the binder straps 48 for moving the sheet items 12 from the posts 32 to travel along the tongue members 38. It is contemplated that angling of the posts 32 inwardly toward the spine panel 22, as described above, may facilitate engagement of the tongue members 38 with the posts 32, as well as assist in smooth movement of the sheet items 12 along the binder straps 48 as they travel between the posts 32 to the tongue members 38.

Figure 5A:
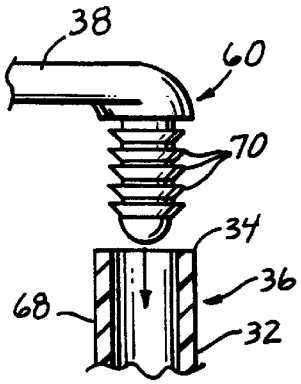
FIG. 5A is a partial side elevational view illustrating the elongated tongue member and post member in accordance with one embodiment of the present invention.

Alternatively, as shown in FIG. 5A, connection members 60 of the tongue members 38 may comprise flared annular rings 70 that have a diameter that is slightly larger than the diameter of the female receptacles 36. As the flared annular rings 70 are inserted into the female receptacles 36, a releasable connection or engagement is established between the tongue members 38 and the posts 32 as will be appreciated by those skilled in the art. Preferably, the annular rings 70 are integrally molded or formed with the tongue members, although it is contemplated that the annular rings 70 could be formed on a plastic or rubber grommet (not shown) that is attached to a post (not shown) formed on the remote end of the tongue members 38.

Figure 5B:
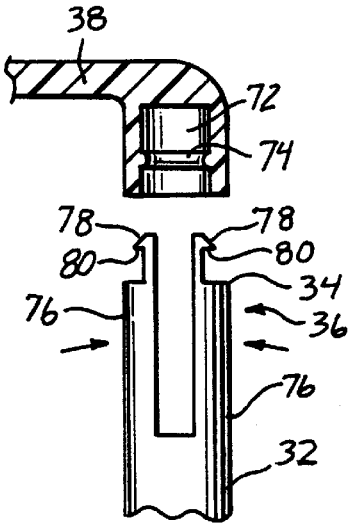
FIG. 5B is a view similar to FIG. 5A illustrating the elongated tongue member and post member in accordance with an alternative embodiment of the present invention.
Figure 5C:
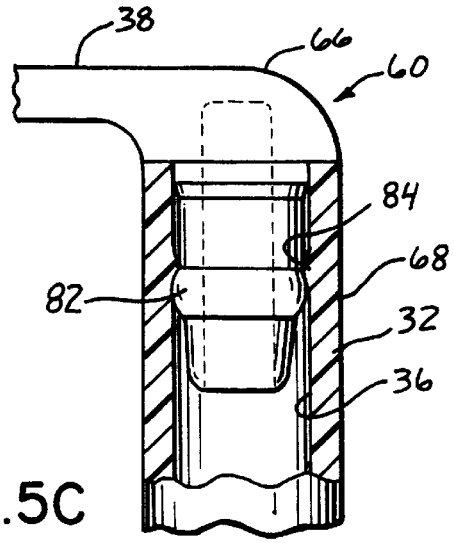
FIG. 5C is a view similar to FIG. 5A illustrating the elongated tongue member and post member in accordance with an another alternative embodiment of the present invention.

In an alternative embodiment of the present invention as shown in FIG. 5B, each tongue member 38 includes a female receptacle 72 formed on a remote end that includes a radially inwardly directed annular ring 74. Each post 32 is formed with two or more flange members 76 that terminate in barbs 78 having abrupt shoulders 80. As the remote ends of the flange members 76 are inserted into the female receptacles 72, the barbs 78 travel past the radially inwardly directed annular ring 74, and the abrupt shoulders 80 engage and are retained by the annular ring 74. The flange members 76 are manually compressible toward each other to permit the abrupt shoulders 80 to be disengaged from the annular shoulder 74. In this way, a locking engagement may be established between the tongue members 38 and posts 32.

As shown in the alternative embodiment of 5C, each tongue member 38 includes a radially outwardly directed annular ring 82 formed on a remote end. Each post 32 is formed with a radially inwardly directed annular ring 84 that is adapted to form a "snap fit" when the annular ring 82 of the tongue members 38 travels past the annular ring 84 of the posts 32. In this way, audible and tactile indications are provided to the user that an engagement has been established between the tongue members 38 and posts 32.

In use of the storage device 10, the storage cover device 16 is unfolded to the open position as shown in FIG. 1 so that one or more sheet items 12 may be inserted onto the posts 32 to register the sheet items 12 relative to the storage device cover 16. The tongue members 38 are folded at living hinges 42, 44 to be brought into engagement with the posts 32 to form the binder straps 48. At this point, the sheet items 12 are free to travel on the binder straps 48 from a first position lying generally parallel with the rear panel 20 to a second position lying generally parallel with the front panel 18, as best understood with reference to FIG. 3. When access to the sheet items 12 is no longer required, the storage device cover 16 is folded to the closed position as shown in FIG. 7 to close the storage chamber 30 of the storage device 10. When one or more sheet items 12 are to be added or removed from the storage device 10, the engagement between each tongue member 38 and post 32 is released to permit materials to be added to or removed from the posts 32.

Figure 8:
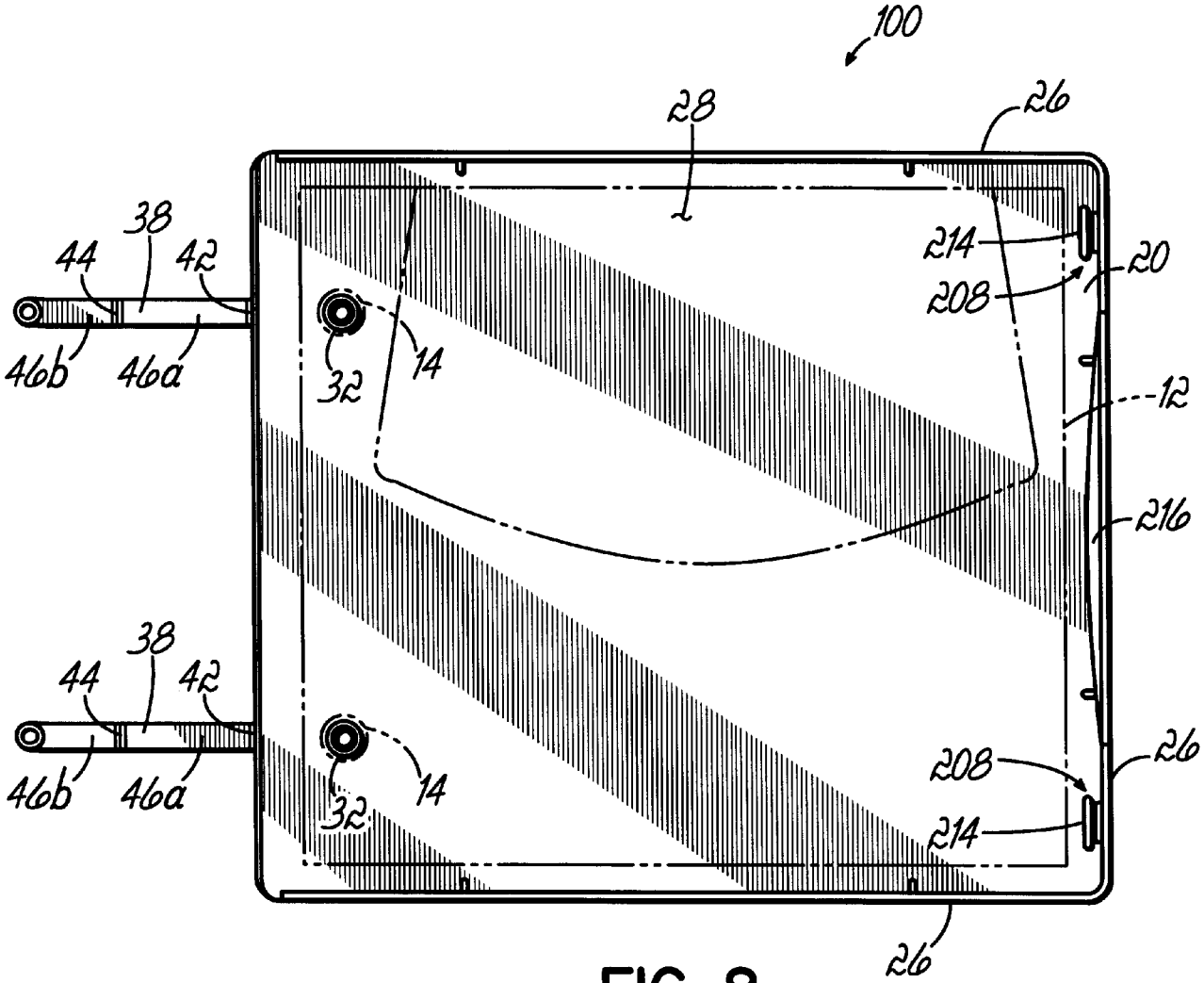
FIG. 8 is a view similar to FIG. 1 showing a storage device in accordance with an alternative embodiment of the present invention.

With reference now to FIG. 8, a storage device 100 in accordance with an alternative embodiment of the present invention is shown, where like numerals represent like parts to the embodiment of storage device 10 illustrated in FIGS. 1–7. In accordance with this aspect of the present invention, the front panel 18 and spine panel 22 of storage device 10 are removed so that storage device 100 includes rear panel 20, continuous flange wall 26 extending upwardly from an inner surface 28 of the panel 20 proximate marginal edge s of the panel 20, one or more of the binding mechanisms 32 (two shown), preferably in the form of spaced rigid or semi-rigid posts, and one or more of the binding mechanisms 38 (two shown), preferably in the form of elongated tongue members. As described in detail above, the posts 32 are operable to extend completely through the apertures 14 formed in the sheet items 12 to register the sheet items 12 relative to the panel 20. The tongue members 38 are connected adjacent an elongated edge 90 of the panel 20 so that the tongue members 38 are folded into engagement with the posts 32 to form the elongated binder straps 48 (see FIGS. 3 and 4) upon which sheet items 12 are free to travel. Preferably, tongue members 38 are connected adjacent the elongated edge 90 through respective living hinges 42 that are disposed adjacent the elongated edge 90. The tongue members 38 preferably include at least one of the living hinges 44 extending generally transverse to the longitudinal length of the tongue member 38. The living hinges 44 permit the tongue members 38 to be folded into multiple segment components 46*a*, 46*b* as described in detail above.

Figure 9A:
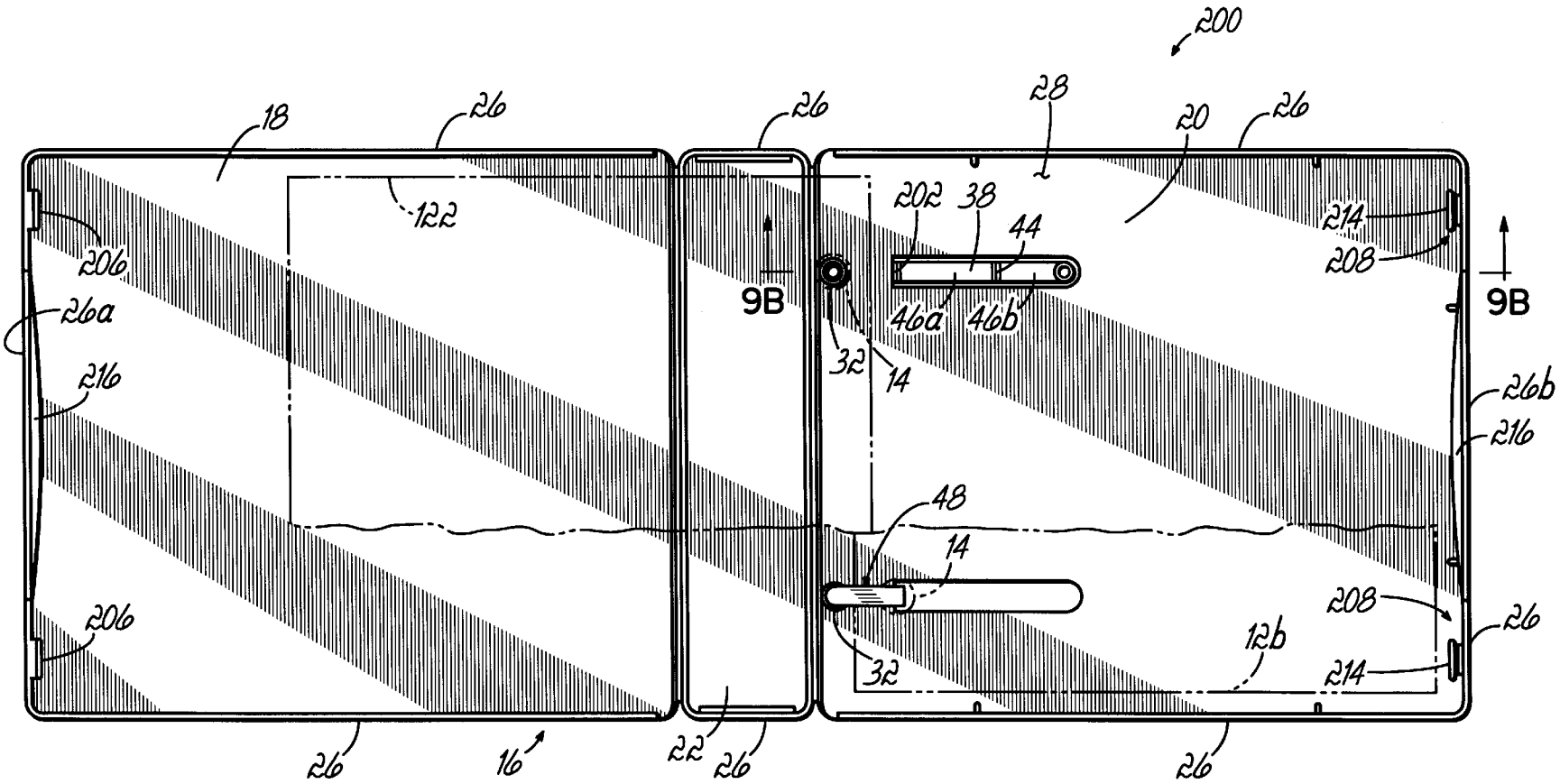
FIG. 9A is a view similar to FIG. 1 showing a storage device in accordance with another embodiment of the present invention.
Figure 9B:
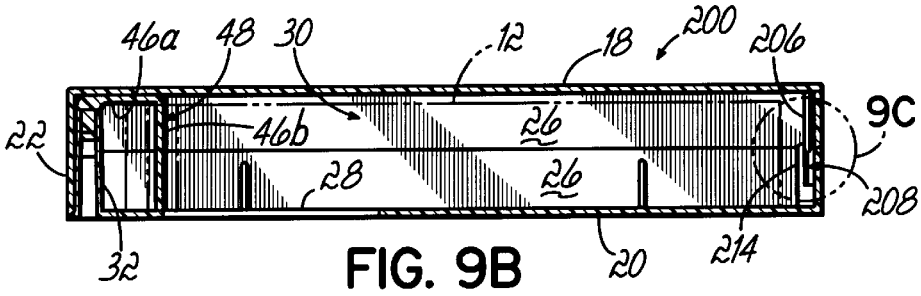
FIG. 9B is a cross-sectional view taken along line 9B—9B of FIG. 9A showing the storage device in a closed position.
Figure 9C:
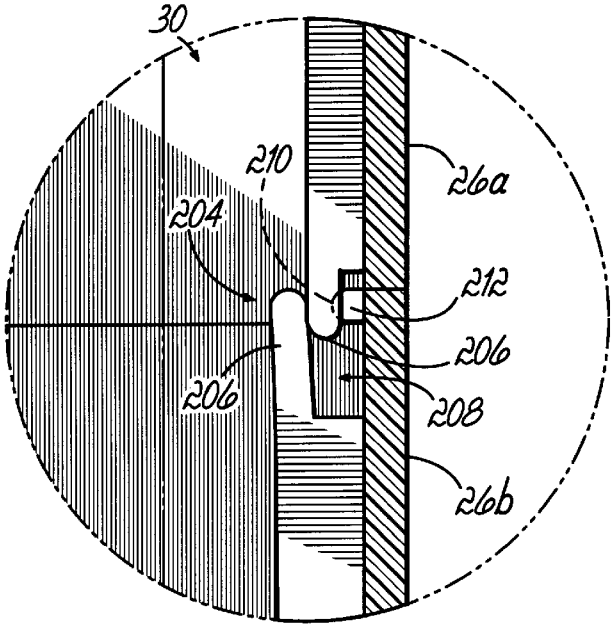
FIG. 9C is an enlargement of the circled area of FIG. 9B.

Referring now to FIGS. 9A–9C, a storage device 200 in accordance with an alternative embodiment of the present invention is shown, where like numerals represent like parts to the embodiment of storage device 10 illustrated in FIGS. 1–7. Storage device 200 differs from storage device 10 predominantly in the movement of posts 32 inwardly toward the living hinge 24*b*, and in the connection of the tongue members 38 to the rear panel 20. More particularly, as shown in FIGS. 9A and 9B, the tongue members 38 are connected to the rear panel 20 so that the tongue members 38 are operable to move independently of the front and rear panels 18, 20 into folding engagement with the respective posts 32. Preferably, the tongue members 38 are connected to the rear panel 20 through respective living hinges 202, although other connections that permit folding of the tongue members 38 are possible as well as described in detail with reference to FIGS. 1–7.

In use of storage device 200, the storage device cover 16 is unfolded to the open position as shown in FIG. 9A so that one or more sheet items 12 may be inserted onto the posts 32 to register the sheet items 12 relative to the storage device cover 16. The tongue members 38 are folded at living hinges 202 to be brought into engagement with the posts 32 to form the binder straps 48. At this point, the sheet items 12 are free to travel on the binder straps 48 from a first position lying generally parallel with the front panel 18, indicated by sheet item 12*a* illustrated in phantom in FIG. 9A, to a second position lying generally parallel to the rear panel 20, indicated by sheet item 12*b* illustrated in phantom in FIG. 9A. After the sheet items 12 are moved along the binder straps 48 from the posts 32 to the tongue members 38, the storage device cover 16 may be closed, as shown in FIG. 9B. Thereafter, when the storage device cover 16 is opened, the sheet items 12 are free to travel from a first position lying generally parallel with the rear panel 20 to a second position lying generally parallel with the front panel 18, generally similar in operation to storage device 10 of FIGS. 1–7. When one or more sheet items 12 are to be added or removed from the storage device 10, the engagement between each tongue member 38 and post 32 is released to permit materials to be added to or removed from the posts 32 or tongue members 38.

As shown in FIGS. 9B and 9C, when access to the sheet items 12 is no longer required, the storage device cover 16 may be folded to a closed position to close the storage chamber 30 of the storage device 200. To releasably retain the storage device cover 16 in the closed position, a locking device 204 is provided on the flange wall 26 which is applicable to the embodiments of storage devices 10 and 200. The locking device 204 includes one or more tabs 206 supported by the flange wall 26*a* of the front panel 18 that are in registry with channels 208 supported on flange wall 26*b* of the rear panel 20, although the tabs 206 and channels 208 could be reversed without departing from the spirit or scope of the present invention. Each tab 206 includes a recess 210 (FIG. 9C) that is adapted to receive a detent 212 that extends from the flange wall 26*b* toward the recess 210. Each channel 208 is preferably formed by the flange wall 26*b* and a flexible tab 214 that is spaced from and generally parallel with the flange wall 26*b*. Each channel 208 is configured to releasably capture the tab 206 between the detent 212 and the flexible tab 214 (FIG. 9C) to releasably retain the storage device cover 16 in the closed position. Recesses 216 may be provided on respective outer surfaces of the flange walls 26*a*, 26*b* that are configured to receive a user's fingers to facilitate opening of the storage device cover 16. Of course, other locking device structures that are operable to releasably retain the storage device cover in the closed position are possible without departing from the spirit and scope of the present invention.

Figure 10:
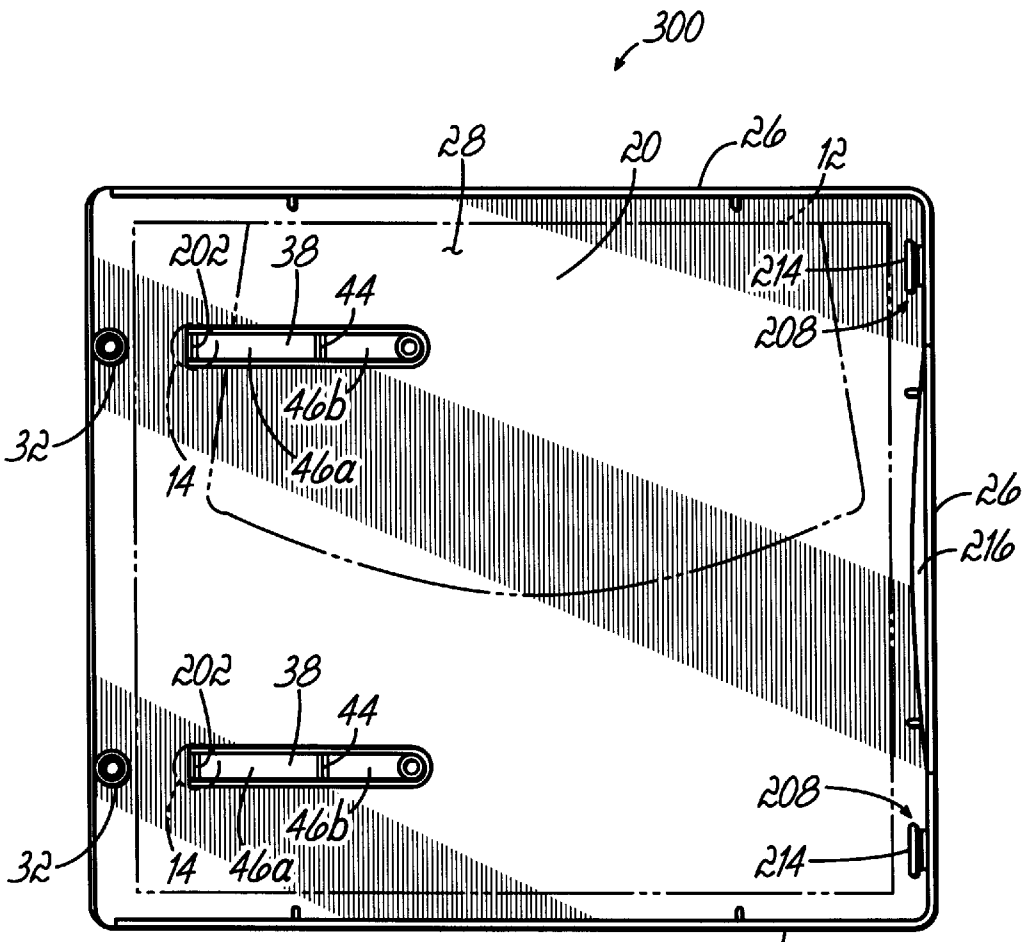
FIG. 10 is a view similar to FIG. 1 showing a storage device in accordance with yet another alternative embodiment of the present invention.

Referring now to FIG. 10, a storage device 300 in accordance with an another alternative embodiment of the present invention is shown, where like numerals represent like parts to the embodiment of storage device 200 illustrated in FIGS. 9A–9C. In accordance with this aspect of the present invention, the front panel 18 and spine panel 22 of storage device 200 are removed so that storage device 300 includes rear panel 20, continuous flange wall 26 extending upwardly from an inner surface 28 of the panel 20 proximate marginal edges of the panel 20, one or more of the binding mechanisms 32 (two shown), preferably in the form of spaced rigid or semi-rigid posts, and one or more of the binding mechanisms 38 (two shown), preferably in the form of elongated tongue members. As described in detail above, the posts 32 are operable to extend completely through the apertures 14 formed in the sheet items 12 to register the sheet items 12 relative to the panel 20. The tongue members 38 are connected to the panel 20 so that the tongue members 38 are folded into engagement with the posts 32 to form the elongated binder straps 48 (see FIG. 9A) upon which sheet items 12 are free to travel. Preferably, tongue members 38 are connected to the panel 20 through respective living hinges 202. The tongue members 38 preferably include at least one of the living hinges 44 extending generally transverse to the longitudinal length of the tongue member 38. The living hinges 44 permit the tongue members 38 to be folded into multiple segment components 46*a*, 46*b* as described in detail above.

Figure 11A:
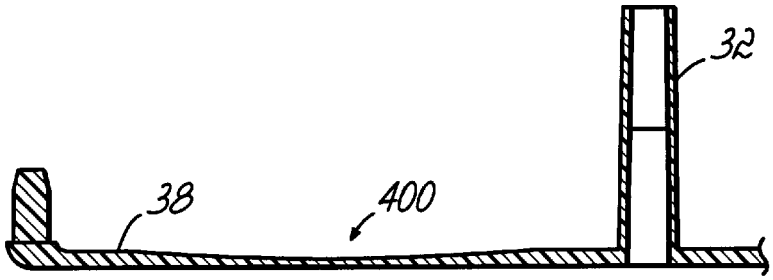
FIG. 11A is a partial side elevational view showing an elongated tongue member and post member in accordance with an alternative embodiment of the present invention.
Figure 11B:
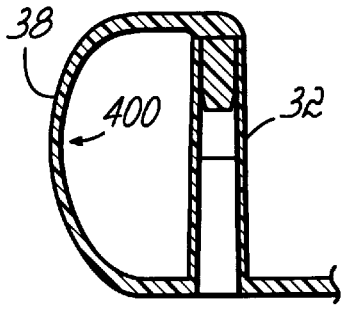
FIG. 11B is a view similar to FIG. 11A showing the elongated tongue member engaged with the post member to form a binder strap.

With reference now to FIGS. 11A and 11B, an alternative embodiment of the binding members 38 is shown. In this embodiment, the binding members 38 are preferably in the form of elongated tongue members (one shown) that are flexible at least partially along their length so that the tongue members may be folded into engagement with the posts 32. In accordance with this aspect of the present invention, the tongue members 38 may include a reduced thickness area, indicated generally at 400, that permits the tongue member 38 to be folded into an arcuate shape as shown in FIG. 11B, thereby eliminating the transverse living hinges 44 as described in detail above.

Figure 12A:
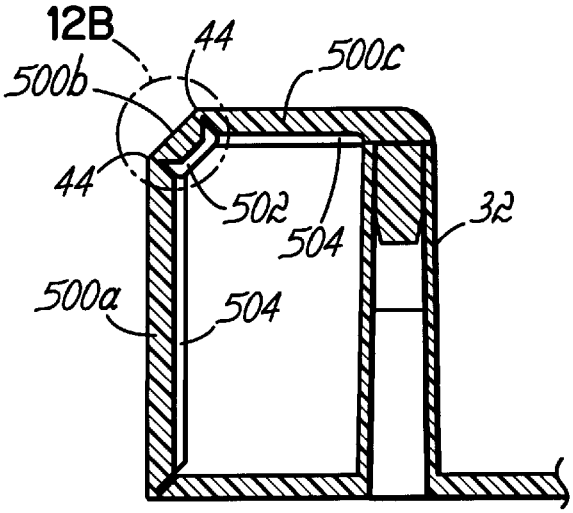
FIG. 12A is a view similar to FIG. 11B showing an elongated tongue member and post member in accordance with another alternative embodiment of the present invention.
Figure 12B:
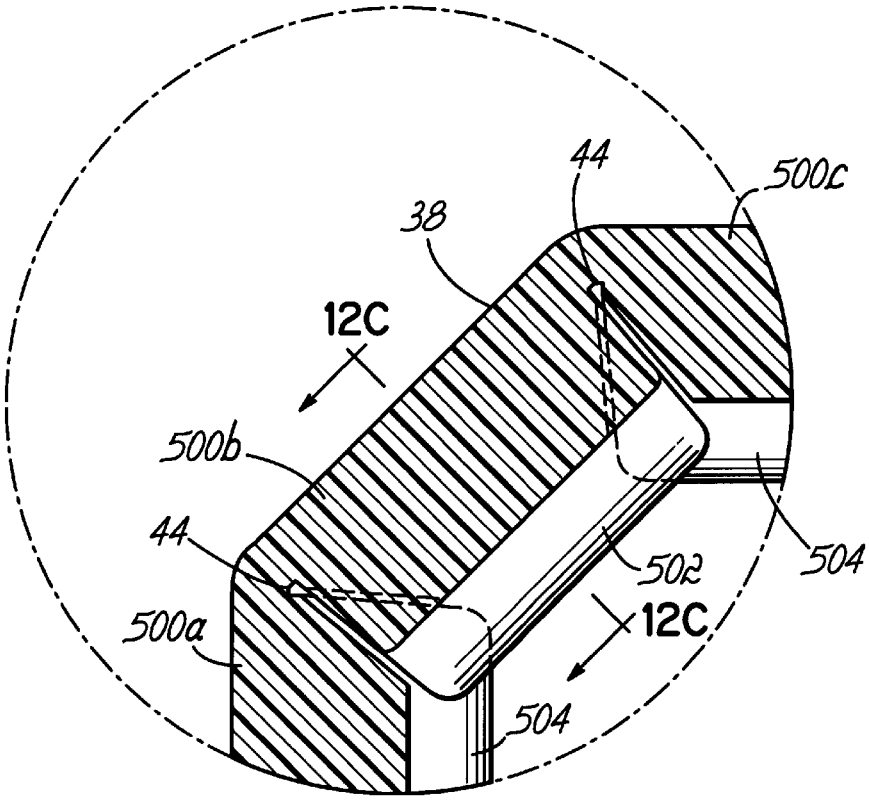
FIG. 12B is an enlargement of the circled area of FIG. 12A.
Figure 12C:
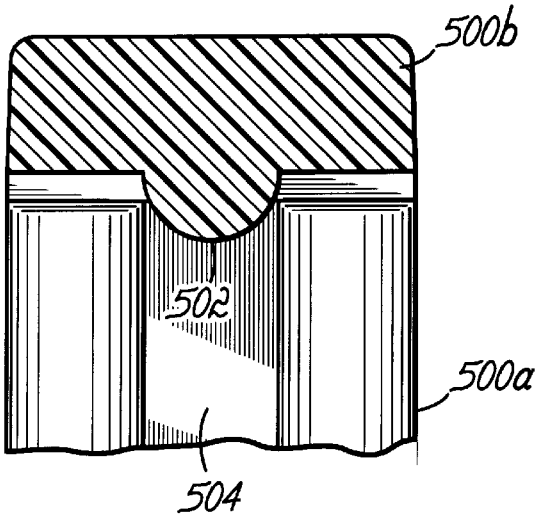
FIG. 12C is a cross-sectional view taken along line 12C—12C of FIG. 12B.
Figure 13A:
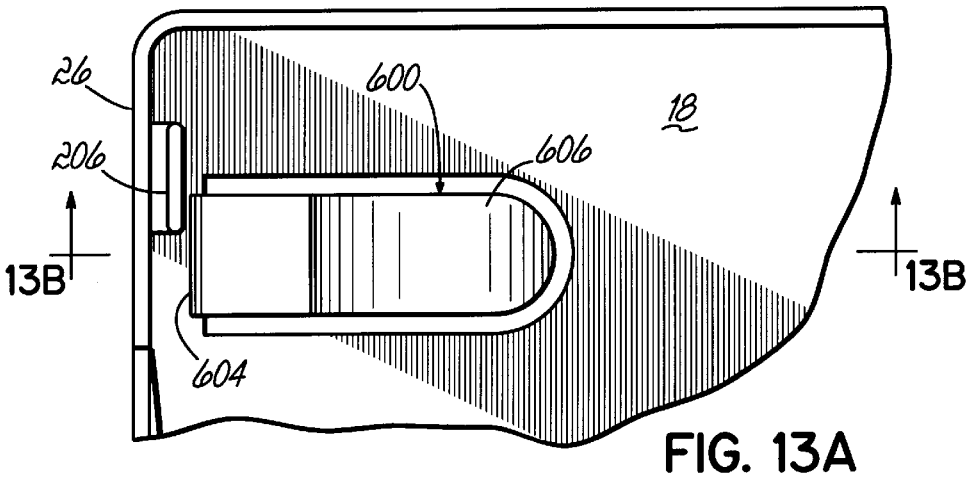
FIG. 13A is a partial plan view of a storage device including a resilient clip in accordance with one embodiment of the present invention.
Figure 13B:
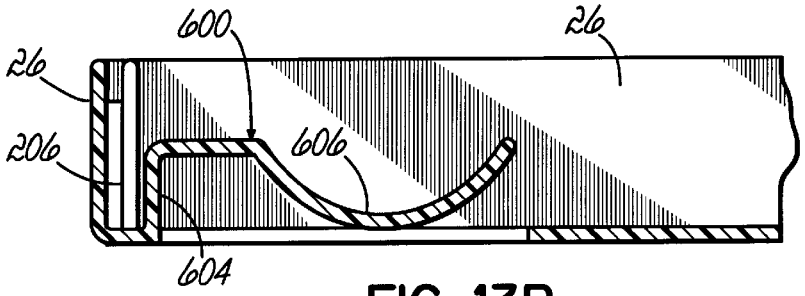
FIG. 13B is a cross-sectional view taken along line 13B—13B of FIG. 13A.
Figure 13C:
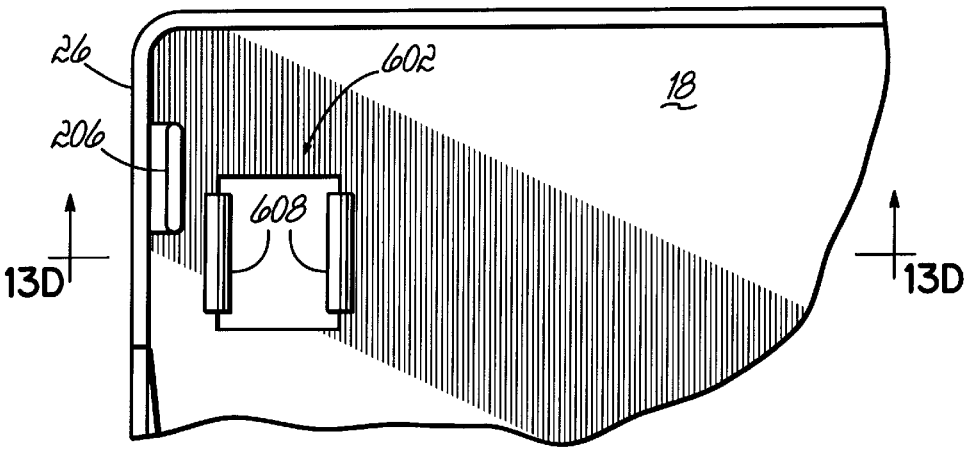
FIG. 13C is a view similar to FIG. 13A showing a resilient clip in accordance with an alternative embodiment of the present invention.
Figure 13D:
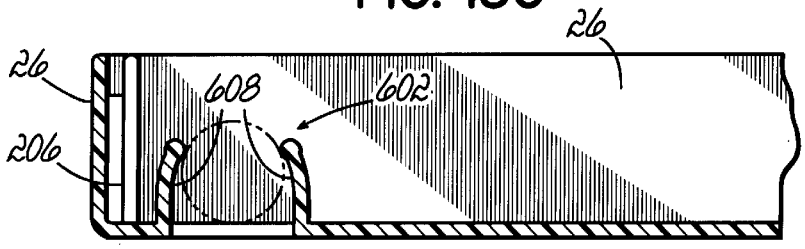
FIG. 13D is a cross-sectional view taken along line 13D—13D of FIG. 13C.

Another alternative embodiment of binding member 38, preferably in the form of an elongated tongue member, is shown in FIGS. 12A–12C. In accordance with this aspect of the present invention, the tongue member 38 includes multiple segment components 500*a*, 500*b* and 500*c* that are formed by the transverse living hinges 44. To provide a generally smooth transition of a sheet item (not shown) along the tongue member 38 so that the sheet item does not snag or catch near the areas of the living hinges 44, the segment component 500*b* includes a rib 502 and the segment components 500*a*, 500*c*, each include a channel 504. In this way, the rib 502 of segment component 500*b* is received in the respective channels 504 of segments components 500*a*, 500*c*, so there is no gap or recess formed by the living hinges 44 that may otherwise snag or catch a sheet item as it moves along the tongue member 38. Of course, the locations of the rib 502 and channels 504 may be reversed, and those skilled in the art will appreciate that other structures are possible that will permit essentially snag-free movement of the sheet items on the tongue member 38 without departing from the spirit and scope of the present invention.

As shown in FIGS. 13A–13D, and applicable to all embodiments of the storage devices 10, 100, 200 and 300, various resilient clip structures 600 (FIGS. 13A and 13B) and 602 (FIGS. 13C and 13D) may be incorporated into one or more of the panels 18, 20 (front panel 18 shown) of the various storage devices. For example, resilient clip 600 includes a leg 604 and a transverse resilient leg 606 that are configured to releasably secure a sheet item, booklet or similar generally flat item (not shown) between the resilient leg 606 and one of the panels 18, 20 as will be readily appreciated by those skilled in the art. Alternatively, resilient clip 602 includes a pair of spaced apart, parallel resilient legs 608 that are configured to releasably secure a writing instrument or similar generally round item (not shown) between the resilient legs 608 as will be readily appreciated by those skilled in the art. Of course, other resilient clip structures are possible for releasably securing items to the storage device cover 16 without departing from the spirit and scope of the present invention.

Figure 14A:
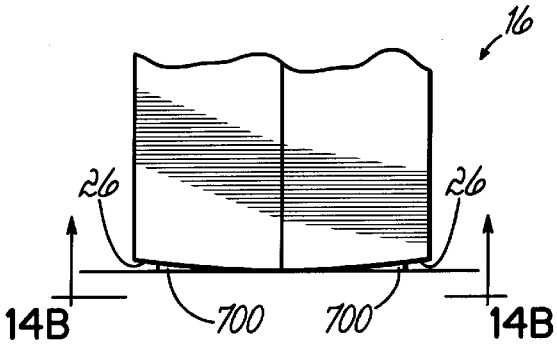
FIG. 14A is a side elevational view of a storage device including supporting feet adapted to engage a support surface.
Figure 14B:
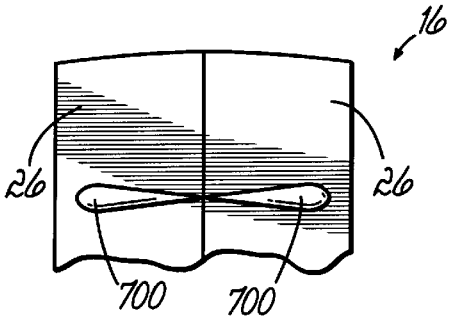
FIG. 14B is view taken along line 14B—14B of FIG. 14A.

As shown in FIGS. 14A and 14B, the storage device cover 16 preferably includes a plurality of support feet 700 that are integrally molded on outer surfaces of the flange wall 26 and adapted to engage a support surface 702. For example, the support feet 700 may have a tear drop configuration, and are molded so that the outermost surfaces of the support feet 700 engage the support surface 702. In this way, the storage devices of the present invention may be readily stored on edge, as shown in FIG. 14A.

While the present invention has been illustrated by a description of various embodiments and while these embodiments have been described in considerable detail, it is not the intention of the applicant to restrict or in any way limit the scope of the appended claims to such detail. Additional advantages and modifications will readily appear to those skilled in the art. For example, while forming the male plug bodies 60 on the tongue members 38, and forming the female receptacles 36 on the posts 32 may be preferred, those skilled in the art will appreciate the multitude of other connection arrangements that could be formed on the tongue members 38 and posts 32 that will permit engagement of the components as desired to form the binder straps 48. Moreover, it will be appreciated that the placement and configuration of the tongue members 38 and posts 32 may be interchanged or modified from the exemplary embodiments described herein without departing from the spirit and scope of the present invention. The invention in its broader aspects is therefore not limited to the specific details, representative apparatus and method, and illustrative example shown and described. Accordingly, departures may be made from such details without departing from the spirit or scope of applicant's general inventive concept.

What is claimed is:

1. A storage device for retaining at least one sheet item, comprising:

a storage device cover operable to move between open and closed positions and including a front panel and a rear panel;

at least one first binding member projecting from said storage device cover and operable to extend completely through the sheet item to register the sheet item relative to said storage device cover; and at least one second binding member connected to said storage device cover and operable to move independently of said front and rear panels into folding engagement with said first binding member to form an elongated binder strap upon which the sheet item is free to travel from a first position lying generally parallel with said rear panel to a second position distant therefrom.

2. The storage device of claim 1, wherein said second binding member is integral with said storage device cover.

3. The storage device of claim 1, wherein said storage device cover further comprises a spine panel disposed intermediate said front and rear panels, wherein said front and rear panels are hingedly connected to opposite elongated sides of said spine panel.

4. The storage device of claim 3 further comprising a first living hinge joining said front panel to one elongated side of said spine panel, and a second living hinge joining said rear panel to the opposite elongated side of said spine panel.

5. The storage device of claim 1 further comprising a living hinge associated with said second binding member to permit said second binding member to be folded into engagement with said first binding member.

6. The storage device of claim 4, wherein said second binding member has one end joined to said second living hinge to permit said second binding member to be folded into engagement with said first binding member.

7. The storage device of claim 5, wherein said second binding member has at least one living hinge extending generally transverse to a longitudinal length thereof to permit said second binding member to be folded into multiple segment components.

8. The storage device of claim 7, wherein each of said multiple segment components includes a substantially linear component along the respective lengths thereof.

9. The storage device of claim 1, wherein said first binding member comprises a post member extending away from one of said front and rear panels.

10. The storage device of claim 9, wherein said post member is integral with one of said front and rear panels.

11. The storage device of claim 9, wherein said post member is attached to one of said front and rear panels.

12. The storage device of claim 1, wherein said second binding member comprises an elongated tongue member.

13. The storage device of claim 1, wherein said storage device cover is formed in one piece of a resiliently deformable plastic material.

14. The storage device of claim 1, wherein said storage device cover has a substantially continuous flange wall extending away from said storage device cover in a common direction proximate marginal edges thereof.

15. The storage device of claim 1 further comprising an overlay attached to an outer surface of said storage device cover.

16. The storage device cover of claim 1 wherein said second binding member is flexible at least partially along its length.

17. The storage device of claim 5 wherein said second binding member comprises an elongated tongue member having one end joined to said living hinge.

18. The storage device cover of claim 1 further comprising a resilient clip associated with at least one of said front and rear panels and adapted to releasably secure an item to said storage device cover.

19. The storage device of claim 14 wherein said storage device cover includes a releasably engageable locking device associated with said flange wall and adapted to releasably retain said storage device cover in said closed position.

20. The storage device of claim 14 further comprising a plurality of projections extending outwardly from said flange wall and adapted to engage a support surface.

21. The storage device of claim 7 wherein said second binding member includes a first segment component having a rib member and a second segment component having a channel member, wherein said channel member is adapted to at least partially receive said rib member therein upon folding of said second binding member into engagement with said first binding member.

22. The storage device of claim 1 wherein said second binding member has one end connected to said rear panel.

23. The storage device of claim 5 wherein said living hinge is associated with said rear panel.

24. The storage device of claim 1 wherein one of said first and second binding members terminates in a female receptacle and said other terminates in a male plug body, wherein said female receptacle is adapted to receive said male plug body.

25. The storage device of claim 24 wherein said female receptacle is releasably engageable with said male plug body.

26. The storage device of claim 24 wherein said female receptacle is lockably engageable with said male plug body.

27. A storage device for retaining at least one sheet item, comprising:

a panel;

at least one first binding member projecting from said panel and operable to extend completely through the sheet item to register the sheet item relative to said panel; and at least one second binding member connected to said panel and operable to move independently of said panel into folding engagement with said first binding member to form an elongated binder strap upon which the sheet item is free to travel from a first position lying generally parallel with said panel to a second position distant therefrom.

28. The storage device of claim 27, wherein said second binding member is integral with said panel.

29. The storage device of claim 27 further comprising a living hinge associated with said second binding member to permit said second binding member to be folded into engagement with said first binding member.

30. The storage device of claim 29, wherein said second binding member has at least one living hinge extending generally transverse to a longitudinal length thereof to permit said second binding member to be folded into multiple segment components.

31. The storage device of claim 30, wherein each of said multiple segment components includes a substantially linear component along the respective lengths thereof.

32. The storage device of claim 27, wherein said first binding member comprises a post member extending away from said panel.

33. The storage device of claim 32, wherein said post member is integral with said panel.

34. The storage device of claim 32, wherein said post member is attached to said panel.

35. The storage device of claim 27, wherein said second binding member comprises an elongated tongue member.

36. The storage device of claim 27, wherein said panel has a substantially continuous flange wall extending away from said panel in a common direction proximate marginal edges thereof.

37. The storage device of claim 29 wherein said second binding member comprises an elongated tongue member having one end joined to said living hinge.

38. The storage device of claim 30 wherein said second binding member includes a first segment component having a rib member and a second segment component having a channel member, wherein said channel member is adapted to at least partially receive said rib member therein upon folding of said second binding member into engagement with said first binding member.

39. The storage device of claim 27 wherein said second binding member has one end connected adjacent an elongated edge of said panel.

40. The storage device of claim 29 wherein said living hinge is disposed adjacent an elongated edge of said panel.

41. The storage device of claim 27 wherein one of said first and second binding members terminates in a female receptacle and said other terminates in a male plug body, wherein said female receptacle is adapted to receive said male plug body.

42. The storage device of claim 41 wherein said female receptacle is releasably engageable with said male plug body.

43. The storage device of claim 41 wherein said female receptacle is lockably engageable with said male plug body.

* * * * *